United States Patent [19]

Jansen

[11] Patent Number: 4,646,591

[45] Date of Patent: Mar. 3, 1987

[54] APPARATUS FOR A BAND CLAMPING TOOL

[75] Inventor: George A. Jansen, Denver, Colo.

[73] Assignee: Band-It-Houdaille, Inc., Denver, Colo.

[21] Appl. No.: 704,789

[22] Filed: Feb. 25, 1985

[51] Int. Cl.[4] ..... B25B 27/10

[52] U.S. Cl. ..... 81/9.3; 140/153

[58] Field of Search ..... 81/9.3; 140/93.2, 123.5, 140/123.6, 150, 153, 154

[56] References Cited

U.S. PATENT DOCUMENTS

| | | | |
|---|---|---|---|
| 1,442,402 | 8/1921 | Gunn | 81/9.3 |
| 1,541,136 | 1/1924 | Gunn | 81/9.3 |
| 2,115,736 | 5/1938 | McAneny | 81/9.3 |
| 2,197,177 | 4/1940 | Faulkner | 140/123.5 |
| 2,312,400 | 3/1943 | Govanus | 81/9.3 |
| 2,513,438 | 7/1950 | Weir . | |
| 3,258,040 | 6/1966 | Evans | 81/9.3 |

*Primary Examiner*—Frederick R. Schmidt
*Assistant Examiner*—Bradley I. Vaught
*Attorney, Agent, or Firm*—Sheridan, Ross & McIntosh

[57] ABSTRACT

A band tightening tool is provided having a pair of stamped members, each of which has the same structural configuration. The two stamped members are fixedly joined together by a welding process. When connected together, the two stamped members define a channel, a pair of cross holes and an open area. The two cross holes receive a band tightening mandrel having a mandrel slot. The cross holes and mandrel include cooperating retaining elements to prevent unwanted separation of the mandrel from the cross holes. To tighten a band about an object, the end portion of the band is inserted through the channel defined by the two stamped members so that the band end portion can be attached to the band tightening tool. Rotational movement of the band tightening mandrel causes the band to be tightened about the object. In so doing, the open area between the channel and the cross holes acts to accommodate the band portions being wrapped around the mandrel. In one embodiment, a cutting assembly can be used to sever the band portion from the remaining portions of the band while, in certain applications, a punch assembly attached to the two stamped members can be employed to deform a portion of the band.

12 Claims, 8 Drawing Figures

4
8

APPARATUS FOR A BAND CLAMPING TOOL

FIELD OF THE INVENTION

This invention relates to a band tightening tool and a method for making and using the tool.

BACKGROUND INFORMATION

In conjunction with the tightening of band clamps on hoses or other objects, a number of tools have been developed and produced which facilitate the tightening of the clamp. Such tools include devices having a number of parts for tightening the band clamp, rolling over the end portion of the band clamp after tightening, and then cutting the end portion of the band clamp adjacent to a buckle located around a portion of the band clamp. Such devices range from relatively complex and expensive machines to more simple tools that can be readily carried by the user and conveniently employed at desired locations in connection with the tightening of a band clamp.

Although a number of band tightening tools have been devised, the need for less expensive and easily manufactured and assembled band tightening tools, which can be carried by the user and utilized on a variety of band clamps, still remains. In that regard, the present invention is directed to a band tightening tool that can be inexpensively made and can be made of a minimum number of parts. In particular, the present invention is characterized by the use of a pair of stamped members which have the same structural configuration.

SUMMARY OF THE INVENTION

A band tightening tool is disclosed which includes a pair of stamped members, each of which has the same structural configuration. When fixedly connected together, the two stamped members define a pair of cross holes that are laterally spaced across from each other. A band tightening mandrel is inserted into the cross holes and removably held therein. The band tightening mandrel includes a head and a shaft connected to the head. A mandrel slot is formed in the shaft for receiving an end portion of the band to be tightened. The shaft of the mandrel also has a retaining element such as a collar or flared end to prevent unwanted disengagement of the band tightening mandrel from the cross holes formed by the two stamped members. The two stamped members further form a slit for receiving the band end portion, which passes through the slit and then through a channel formed between the two stamped members. From the channel, the band end portion passes into an open area from which it is received into the mandrel slot.

In one embodiment, the band tightening tool includes a cutting assembly having a blade for severing a desired length of the end portion of the band from the remaining portions of the band. In another embodiment of the invention, the two connected stamped members also define a pair of apertures. The apertures are used to connect the punch assembly to the body of the tool. The punch assembly includes a punch body that can be used with certain kinds of buckles which surround a portion of the band. The user of the tool, by means of an appropriate device, strikes the punch body when it is appropriately aligned relative to the buckle in order to deform the band. Such deformation is used to prevent slippage of the band relative to the buckle.

To make the tool, each of the two stamped members is produced by a stamping process utilizing a strip of metal wherein desired raised portions and openings are provided in each stamped member. In one embodiment, the stamped members further include protrusions located at desired positions along the longitudinal extent of the stamped members. Two stamped members can be joined together by a welding process utilizing the protrusions. Once joined together by the welding process, the two stamped members form the desired cross holes, openings, and the channel, which are required in tightening of the band. The mandrel can then be inserted into the cross holes. In conjunction with the tightening of the band, after the band with buckle is located about an object to which the band clamp is to be attached, the end portion of the band is inserted into the slit formed at an end of the two stamped members. Continued movement of the band end porton results in it passing through the channel and the open area so that it can be joined to the mandrel slot. After inserting the end of the band into the mandrel slot, the mandrel tightening tool can be rotated causing the end portion of the band to be wrapped around the mandrel shaft. This operation causes the band end portion to move relative to the buckle so that the band clamp is tightened about the desired object. In the embodiment including the punch assembly, and in a case in which a buckle is utilized having an opening or slot for receiving a punch, the user can strike the punch body to cause deformation of the band. In the embodiment having the cutting assembly, the band tightening tool is disengaged from the band so that the band end portion to be cut can be positioned adjacent to the cutting assembly. Using the blade of the cutting assembly, the band end portion can be severed from the remaining portions of the band.

In view of the foregoing description, a number of meaningful advantages of the present invention are readily seen. A relatively simple tool for tightening a band clamp is provided. The tool includes a minimum number of parts for accomplishing the desired function of tightening a band about an object, such as a hose. The tool can be efficiently made utilizing a stamping process in which two members are produced having the same configuration. As a result, the tool of the present invention is manufactured at a relatively low cost. In connection with the band tightening mandrel, it can be removed from the two stamped members but includes a retaining portion so that the band tightening mandrel does not unexpectedly and undesirably become disengaged from the two stamped members. Additionally, the tool can include a punch assembly for use with certain kinds of band clamps having a buckle arrangement wherein the punch is used to deform a portion of the band. Further, because of the structural configuration associated with the two stamped members, the tool is also able to house a cutting blade for severing a desired band end portion from the remaining portions of the band.

Additional advantages of the present invention will become readily apparent from the following discussion when taken in conjunction with the accompanying drawings.

DETAILED DESCRIPTION OF THE EMBODIMENTS

Figure 1:
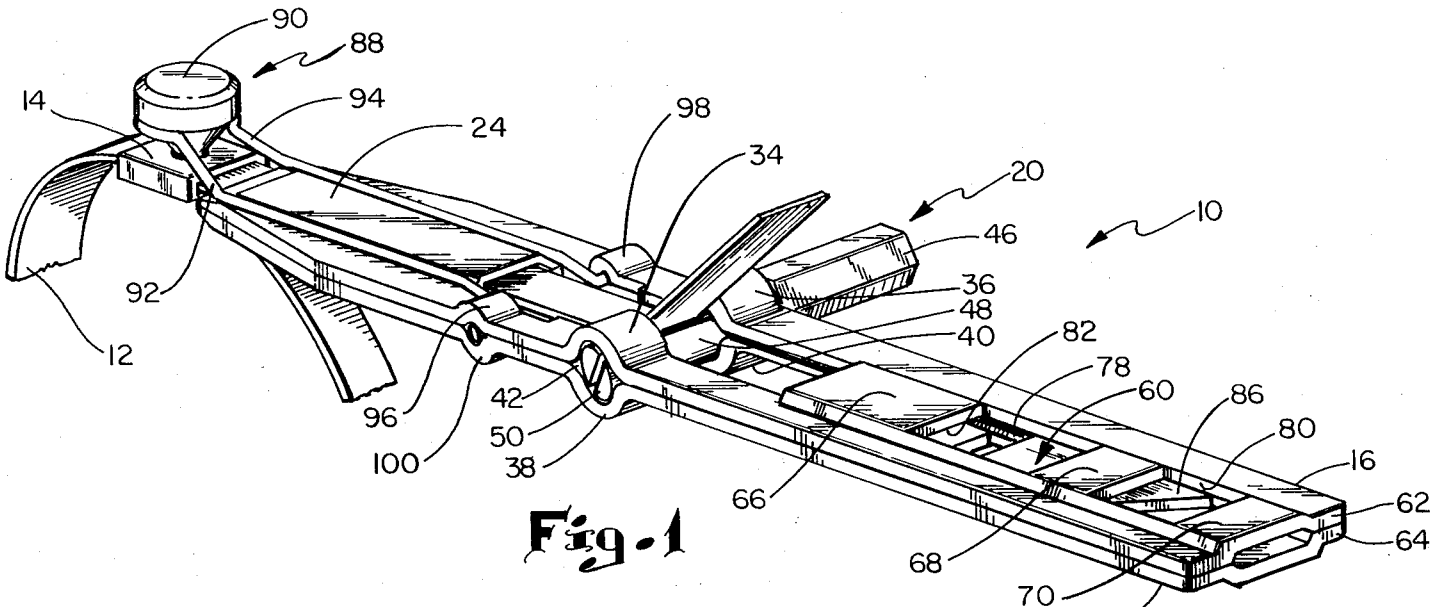
FIG. 1 is a perspective view of the band tightening tool of the present invention showing the embodiments that include a cutting assembly and a punch assembly.
Figure 2:
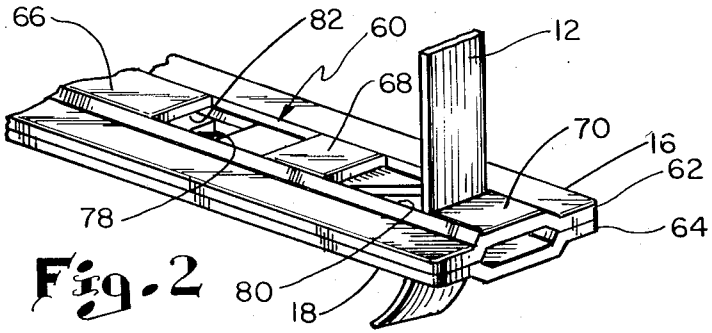
FIG. 2 is fragmentary, perspective view of the rear portion of the tool illustrating the band cutting operation.

In accordance with the present invention and referring to FIG. 1, a band tightening tool 10 is provided for use in tightening a band 12 about an object, such as a hose, by caus:ng movement of the band 12 relative to a buckle 14. The tool 10 includes a first member 16, a second member 18, and a band tightening mandrel 20. The first and second members 16, 18 are of the same physical configuration and are fixedly held together relative to each other, preferably, by welding the two members 16, 18 together so that there is no overlapping portions of the two members 16, 18.

Figures 3, 4, 5, 6, 7:
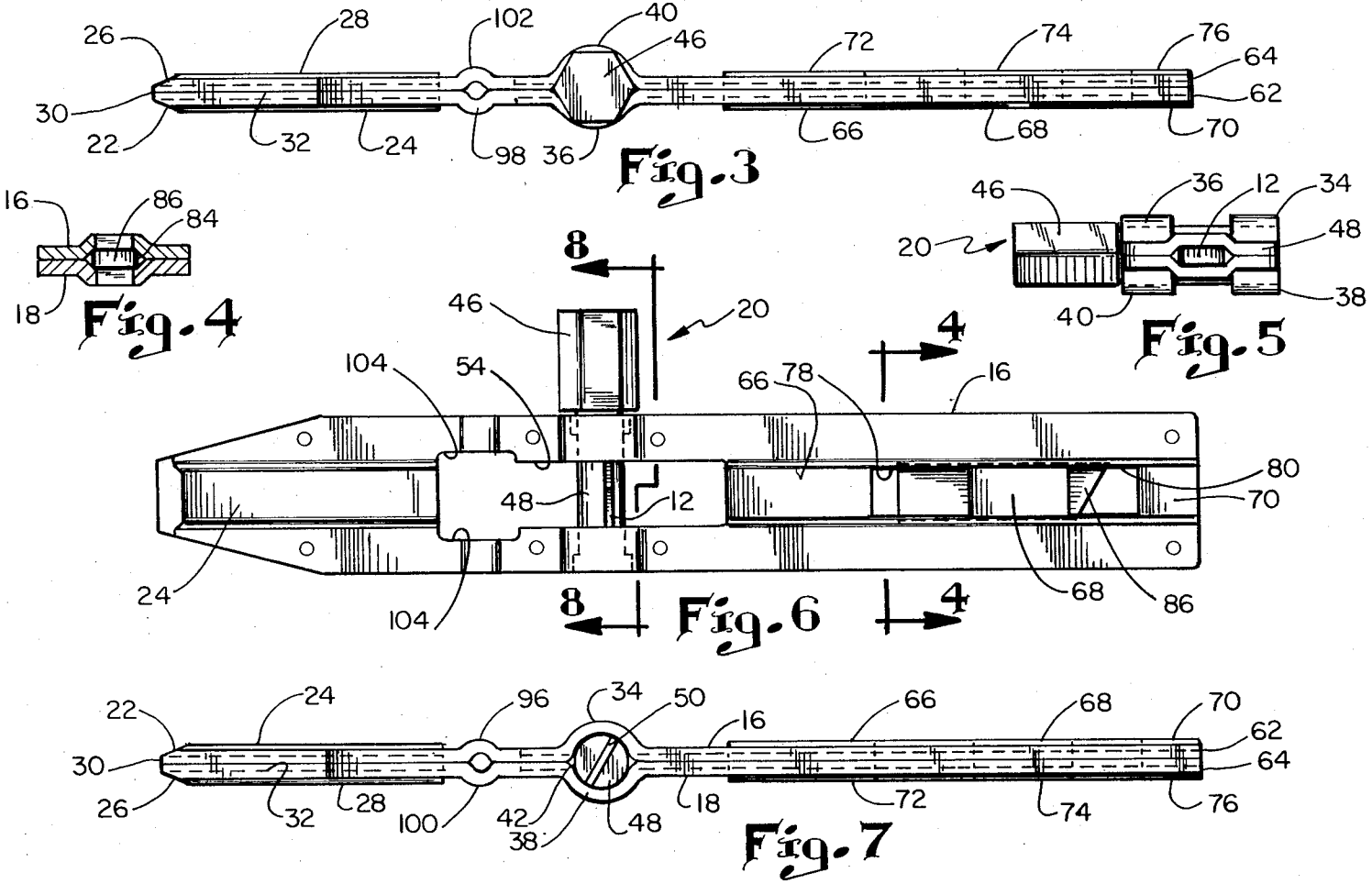
FIG. 3 is a first side elevational view showing the two stamped members joined together.
FIG. 4 is a lateral cross-sectional view, taken along lines 4—4 of FIG. 6, showing the tracks along which the cutting blade moves.
FIG. 5 is a front elevational view showing the mandrel slot and the band received through the slit.
FIG. 6 is a top elevational view of the tool with the punch assembly removed.
FIG. 7 is a second side elevational view showing the two stamped members joined together.

With reference to FIGS. 3 and 7, as well as FIG. 1, the first member 16 includes a nose end 22 and a raised portion 24 disposed adjacent to the nose end 22 and extending outwardly from the main body of the first member 16. Likewise, the second member 18 has a nose end 26 and a raised portion 28 disposed adjacent to the nose end 26. Each of the nose ends 22, 26 are tapered and, with the joining together of the first and second members 16, 18, a slit 30 is defined by the space between the nose end 22 of the first member 16 and the nose end 26 of the second member 18. The aligned raised portions 24, 28 of the first member 16 and second member 18, respectively define a longitudinally extending channel 32 located between the raised portions 24, 28 and which channel 32 communicates with the slit 30. The channel 32 is spaced from the peripheries of the first and second members 16, 18, along which peripheries the first and second members 16, 18 are joined together.

The first member 16 also includes a pair of ridges 34, 36 which depart outwardly from the plane of the body of the first member 16. Likewise, the second member 18 includes a pair of ridges 38, 40 which depart from the plane of the body of the second member 18. As can be seen in FIG. 1, as well as FIGS. 5 and 7, the first member ridge 34 and the second member ridge 38 define or form a cross hole 42 located between the two ridges 34, 38. Similarly, the first member ridge 36 and the second member ridge 40 define a cross hole 44. The cross holes 42, 44 act to receive the band tightening mandrel 20 to connect the mandrel 20 to the two members 16, 18. In addition, at least one and preferably all of the ridges 34, 36, 38, 40 include a recessed surface 45, as illustrated in FIG. 6, for use in preventing unwanted detachment of the mandrel 20 from the body of the tool 10.

Figure 8:
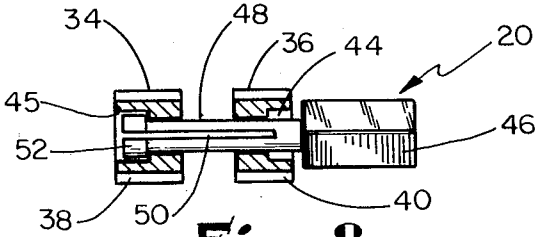
FIG. 8 is a longitudinal sectional view showing the collar of the mandrel and a recessed surface of the ridge.

With regard to the band tightening mandrel 20, this element includes a head 46 and a shaft 48 integrally joined to the head 46. A mandrel slot 50 is formed throughout the longitudinal extent of the shaft 48. As illustrated in FIG. 8, also integrally formed on the shaft 48 is a retainer member or collar 52 in which the width or diameter of the collar 52 is greater than the width of the remaining portions of the shaft 48. The collar 52 is used to prevent unwanted disengagement of the mandrel 20 from the connected first and second members 16, 18. When held in the cross holes 42, 44, the collar 52 contacts one of the recessed surfaces 45 while the non-recessed surface adjacent to the contacted recessed surface 45 acts as a barrier to the removal of the mandrel 20. As a result, because of the differences in the surface levels associated with the cross holes 42, 44, an amount of force must be applied to the mandrel 20 to pull it from the cross holes 42, 44 and thereby separate the mandrel 20 from the members 16, 18. Also forming a part of the band tightening tool 10 is an open area 54, as best seen in FIG. 6, disposed between the ends of the raised portions 24, 28 and the shaft 48 of the mandrel 20. The open area 54 communicates with the channel 32 and must be of at least a size to permit space for the portions of the band 12 to be wrapped around the shaft 48 during the tightening of the band 12.

In addition to the foregoing parts provided in the preferred embodiment, in one embodiment of the band tightening tool 10, a cutting assembly 60 is also provided. The cutting assembly 60 is located adjacent to the rear ends 62, 64 of the first and second members 16, 18, respectively. In conjunction with the cutting assembly 60, the first member 16 includes a pair of uplifted segments 66, 68 and an end part 70. Likewise, the second member 18 includes a pair of uplifted segments 72, 74 as well as an end part 76. Formed between these elements on both the first member 16 and the second member 18 are spaces or openings wherein, when the first member 16 is joined to the second member 18, a slot 78 is defined between first member uplifted segment 66/second member uplifted segment 72 and first member uplifted segment 68/second member uplifted segment 74. Similarly, a window 80 is defined between first member uplifted segment 68/second member uplifted segment 74 and first member end part 70/second member end part 76. The uplifted segments 66, 72, 68, 74 extend outwardly from the main body of the first and second members 16, 18 wherein a passageway 82 is defined having tracks 84, as illustrated in FIG. 4, located along the edges of the passageway 82. In connection with the passageway 82 and the tracks 84, a cutting blade 86 is received by the passageway 82 and the sides of the blade 86 are held in the tracks 84 for movement relative to the longitudinal extent of the tool 10. The blade 86 can be held in the passageway 82 by crimping or deforming the end parts 70, 76 of the tool 10 along the lateral extent thereof while the blade 86 is prevented from moving too far in the opposite longitudinal direction by the contiguous contact between the first and second members 16, 18 near the ends of the first member uplifted segment 66 and the second member uplifted segment 72.

In an embodiment of the invention, the tool 10 further includes a punching assembly 88 for use with particular types of band clamps having buckles in which a portion of the band 12 is to be deformed using the punch assembly 88. With particular reference to FIG. 1, the punching assembly 88 includes a punch body 90 and a pair of legs 92, 94 that connect to the punch body 90 and extend longitudinally adjacent to the raised portion 24 of the first member 16. With regard to the connection of the punch assembly 88 to the tool 10, the first member includes a pair of projections 96, 98 formed along the longitudinal edges of the first member 16. Likewise, the second member 18 has a pair of projections 100, 102 formed along its longitudinal edges so that, when the first member 16 is joined to the second member 18, the first member projection 96 is aligned with the second member projection 100 while the first member projection 98 is aligned with the second member projection 102. This alignment results in a pair of apertures through which the end portions of the legs 92, 94 can be received and held whereby the punch assembly 88 is fixedly joined to the first and second members 16, 18. In order that the legs 92, 94 not interfere with receipt and movement of a band portion through the open area 54, extended spaces or areas 104 are provided that extend the open area 54 in a lateral direction. The extended spaces 104 enable the legs 92, 94 to avoid the area into which the band 12 passes for receipt by the mandrel 20.

With regard to the making of the band tightening tool 10, both the first member 16 and the second member 18 are stamped by a suitable and conventional pressing apparatus or machine. In such a manner, the members 16, 18 can be formed from an elongated, substantially flat metal strip. The stamping operation results in the formation of the raised portions 24, 28, the ridges 34, 36, 38, 40, the uplifted segments 66, 72, 68, 74, the end members 70, 76, the open area 54, the slot 78, the window 80, the projections 96, 98, 100, 102, and the extended spaces 104 in one step. After the stamping operation is completed, two of the resulting stamp members can be joined together to form the major body of the tool 10. In that regard, in one embodiment, protrusion welding is employed whereby protrusions provided on the stamped first and second members 16, 18 are melted using electric current to interconnect the stamped first and second members 16, 18. In another embodiment, spot welding is employed at desired locations along the periphery of the first and second members 16, 18 to fixedly join them together. The mandrel 20 is a separately formed piece and can be inserted into the cross holes 42, 44 after the welding process.

In connection with the use of the band tightening tool 10, the end of the band 12 is first inserted into the slit 30 and caused to move or pushed through the channel 32 and into the open area 54. The user manipulates the mandrel 20 such that the end of the band 12 is inserted into the slot 50 of the shaft 48. The mandrel 20 is rotated by means of a wrench or a like tool connected to the head 46. Rotation of the mandrel 20 causes the band end portion to be wrapped around the shaft 48. Rotational movement of the mandrel 20 is continued until a desired amount of tension is applied by the band 12 to the object, which is surrounded by the band 12.

In those cases in which the buckle 14 is configured for permitting deformation of a portion of the band 12, the user of the tool 10 places the punch body 90 at the desired location and using a hammer or the like strikes the punch body 90 so that the punch body 90 is able to deform the band portion. To disengage the tool 10 from the band 12, the user first rolls the tool 10 over relative to the band 12 by moving the tool 10 and the band end portion about 90° relative to the buckle 14. The roll over reduces the tension being applied to the band end portion by the tool 10. After the roll over, the tool 10 is moved back to its original position at which position the band 12 was tightened, and the user then pulls back on the tool 10 in a direction away from the band 12. In so doing, the portion of the band 12 wrapped around the mandrel shaft 48 is unwrapped and subsequently the band end disconnects from the slot 48. The end portion of the band 12 extending outwardly from the buckle 14 can next be cut using the cutting assembly 60 of the tool 10. In particular, the tool 10 is positioned relative to the end of the band 12 so that it can be received into the window 80. Portions of the band 12 are passed through the window 80 until a desired length of band 12 to be cut has passed through the window 80. Typically, the user chooses to cut the band portion as close to the buckle 14 as can be accomplished using the tool 10. At this time, the blade 86 can be moved in a direction towards that part of the band 12 that is to be severed. To provide movement of the blade 86, a pair of pliers or the like is utilized. One jaw of the pliers is inserted into the slot 78 while the other jaw of the pliers is positioned adjacent the rear ends 62, 64 of the first and second members 16, 18, respectively. Movement of the jaw of the pliers in the slot 78 causes movement of the blade 68 into and through that part of the band 12 to be cut. Usually, after the severing of the band end portion, a small, unseparated portion or tail of the band 12 remains extending tangentially from the buckle 14. Using a hammer or the like, the user is able to roll or bend the tail back over the top of the buckle and position the tail so that it lies essentially flat on top of the buckle 14. In another kind of buckle having two ears, after the tail is bent back, the ears are folded over a portion of the tail to hold the tail in place.

It should be understood that the user need not employ the cutting assembly 60 in order to sever the band end portion from remaining portions of the band 12. Instead, conventional cutting tools may be employed to sever the band end portion. In such a case, this cutting can take place after the band 12 has been tightened about the object and the tool 10 has been used to roll the extended band portion back over the buckle 14. When the band portion is severed by such other cutting means, the mandrel 20 can be used to wrap the cut portion of the band 12 about its shaft 48 and then the mandrel 20 can be removed from the cross holes 42, 44. During the removal, the cut band portion is removed or disengaged from the slot 50 of the mandrel 20.

It should also be further appreciated that, in many applications, the punching assembly 88 is not required or used because of the type of buckle employed with the band clamp 12.

Based on the foregoing detailed description and the illustrations depicting the present invention, it is readily discerned that the present invention has many salient features. A band tightening tool is provided that can be inexpensively and efficiently made and yet be utilized with a variety of band clamps and buckles used with such band clamps. The invention employs a minimal number of parts to perform the necessary tightening operation. In other embodiments, additional parts can be included for severing the band end portion from the remaining portions of the band and for providing a punching capability to deform a portion of the band for use in preventing slippage or relative movement between the band and the buckle. Additionally, to prevent unwanted separation of the mandrel from the body of the tool, the mandrel and the stamped members cooperate to provide desired retention of the mandrel to the body of the tool.

Although the present invention has been described with reference to a plurality of embodiments, it is readily understood that further variations and modifications can be effected within the spirit and scope of this invention.

What is claimed is:

1. An apparatus for tightening the band of a band-type clamp comprising:

a first member including a body and a longitudinally-extending raised portion and at least one ridge extending outwardly from the plane of said body, said raised portion and said ridge of said first member being spaced from each other using an opening formed therebetween, said first member having a nose end and a rear end, said body of said first member including a first surface, a second surface and a pair of relatively narrow sides disposed at edges of said first and second surfaces;

a second member including a body and a longitudinally-extending raised portion and at least one ridge extending outwardly from the plane of said body, said raised portion and said ridge of said second member being spaced from each other using an opening formed therebetween, said second member having a nose end and a rear end, said body of said second member including a first surface, a second surface, and a pair of relatively narrow sides disposed at edges of said first and second surfaces, said first member opening and said second member opening defining an open area of a size into which a band portion is received when the band is tightened and wherein said first member and said second member have the same size, and at least one of said narrow sides of said second member being substantially flush with one of said narrow sides of said first member along substantially the entire longitudinal extents of said first and second members, while said first surfaces contact each other;

a slit defined by said nose ends of said first and second members for receiving a portion of the band;

a longitudinally extending channel formed between said raised portions of said first and second members and communicating with said slit;

at least a first cross hole formed by said ridges of said first and second members; and a band tightening mandrel having a slot for receiving a portion of the band, said band tightening mandrel being removably held in said cross hole and being rotatably movable for tightening the band.

2. An apparatus, as claimed in claim 1, further including:

a second cross hole spaced from but aligned with said first cross hole.

3. An apparatus, as claimed in claim 1, wherein:

said band tightening mandrel includes retaining means for preventing unwanted disengagement of said band tightening mandrel from said first cross hole.

4. An apparatus, as claimed in claim 1, wherein:

said ridge includes retaining means for preventing unwanted disengagement of said band tightening mandrel from said first cross hole.

5. An apparatus, as claimed in claim 1, further including:

a cutting assembly including a blade positioned between said first and second members for cutting a portion of the band after tightening.

6. An apparatus, as claimed in claim 1, further including:

a punch assembly joined to said first and second members, said punch assembly including a punch body for engaging a portion of the band to deform the band portion.

7. An apparatus, as claimed in claim 1, further including:

track means formed between said first and second members; and a blade held between said first and second members in said track means, said blade being movable in said track means and being used to sever a portion of the band from remaining portions of the band.

8. An apparatus, as claimed in claim 1, further including:

a blade;

at least one upligted segment provided on each of said first and second members, said uplifted segment having means for preventing movement of said blade in a longitudinal direction relative to said first and second members; and at least one window formed by said first and second members for receiving a portion of the band.

9. An apparatus, as claimed in claim 3, wherein:

said retaining means includes a collar formed on said mandrel.

10. An apparatus, as claimed in claim 4, wherein:

said retaining means includes a recessed surface formed on said first cross hole.

11. An apparatus, as claimed in claim 1, wherein:

said combined nose ends of said first and second members have substantially the same height as the combined rear ends of said first and second members while said band is being tightened.

12. An apparatus, as claimed in claim 1, wherein:

said first surfaces of said first and second members are fixedly connected together using means located along a plurality of portions of said first surfaces.

* * * * *